US011774179B2

(12) United States Patent
Khatami et al.

(10) Patent No.: US 11,774,179 B2
(45) Date of Patent: Oct. 3, 2023

(54) HEAT EXCHANGER TUBES AND TUBE ASSEMBLY CONFIGURATIONS

(71) Applicant: Rheem Manufacturing Company, Atlanta, GA (US)

(72) Inventors: Reza Khatami, Montgomery, AL (US); Qian Zhang, Montgomery, AL (US); Troy E. Trant, Montgomery, AL (US); Tanjir Hasan Ratul, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 16/512,180

(22) Filed: Jul. 15, 2019

(65) Prior Publication Data

US 2019/0339014 A1 Nov. 7, 2019

Related U.S. Application Data

(62) Division of application No. 15/630,065, filed on Jun. 22, 2017, now abandoned.

(51) Int. Cl.

| | |
|---|---|
| ***F28D 7/16*** | (2006.01) |
| ***F28D 7/10*** | (2006.01) |
| ***F28D 21/00*** | (2006.01) |
| ***F28F 1/06*** | (2006.01) |
| ***F24H 1/28*** | (2022.01) |
| ***F28F 1/02*** | (2006.01) |
| ***F24H 1/36*** | (2022.01) |

(52) U.S. Cl.

CPC ..... *F28D 7/163* (2013.01); *F24H 1/287* (2013.01); *F24H 1/36* (2013.01); *F28D 7/10* (2013.01); *F28D 7/1684* (2013.01); *F28D 21/0007* (2013.01); *F28F 1/025* (2013.01); *F28F 1/06* (2013.01); *F28F 2001/027* (2013.01)

(58) Field of Classification Search

CPC ..... F28D 7/163; F28D 7/1684; F28D 7/10; F28F 1/06; F28F 1/025; F28F 2001/027

See application file for complete search history.

(56) References Cited

U.S. PATENT DOCUMENTS

| | | | | |
|---|---|---|---|---|
| 755,558 | A | 3/1904 | Barber | |
| 1,852,490 | A * | 4/1932 | Sullivan | F28D 7/024 165/109.1 |
| 1,922,838 | A | 8/1933 | Bossart | |

(Continued)

FOREIGN PATENT DOCUMENTS

| | | | |
|---|---|---|---|
| CN | 104136847 | A | 11/2014 |
| WO | 2001092806 | A1 | 12/2001 |

(Continued)

OTHER PUBLICATIONS

International Search Report for PCT/US2018/028371 dated July 5, 2018.

*Primary Examiner* — Jon T. Schermerhorn, Jr.

(74) *Attorney, Agent, or Firm* — Eversheds Sutherland (US) LLP

(57) ABSTRACT

A tube for a thermal transfer device can include at least one wall having an inner surface and an outer surface, where the inner surface forms a cavity. The inner surface can be non-cylindrical. The cavity can be configured to receive a fluid that flows continuously along a length of the at least one wall.

14 Claims, 6 Drawing Sheets

(56) References Cited

U.S. PATENT DOCUMENTS

| | | | | |
|---|---|---|---|---|
| 2,016,720 | A | 10/1935 | Georg | |
| 3,177,936 | A | 4/1965 | Gustave | |
| 3,416,600 | A | 12/1968 | Fink | |
| 3,757,856 | A | 9/1973 | Kun | |
| 4,014,962 | A | 3/1977 | del Notario | |
| 4,589,481 | A * | 5/1986 | Mansson | F28D 7/024 165/172 |
| 5,271,376 | A | 12/1993 | Lu et al. | |
| 5,560,425 | A * | 10/1996 | Sugawara | F28D 1/0435 165/170 |
| 5,655,599 | A * | 8/1997 | Kasprzyk | F28F 21/04 165/184 |
| 5,839,505 | A * | 11/1998 | Ludwig | F28F 13/08 165/109.1 |
| 6,550,533 | B2 | 4/2003 | Nakado et al. | |
| 6,688,378 | B2 | 2/2004 | O'Donnell et al. | |
| 6,938,688 | B2 * | 9/2005 | Lengauer, Jr. | F24H 3/105 165/146 |
| 6,945,320 | B2 * | 9/2005 | Harvard, Jr. | F24H 3/087 165/177 |
| 7,255,155 | B2 | 8/2007 | O'Donnell et al. | |
| 7,743,821 | B2 | 6/2010 | Bunker et al. | |
| 8,235,098 | B2 | 8/2012 | Agee | |
| 8,240,364 | B2 | 8/2012 | Schmitz | |
| 8,267,163 | B2 | 9/2012 | Stewart | |
| 8,281,635 | B2 | 10/2012 | Beppu | |
| 8,376,033 | B2 | 2/2013 | Robidou et al. | |
| 8,387,251 | B2 | 3/2013 | Beppu | |
| 8,459,342 | B2 * | 6/2013 | O'Donnell | F24H 9/0026 165/109.1 |
| 8,720,387 | B2 | 5/2014 | Pacholski | |
| 8,783,334 | B2 * | 7/2014 | Lovato | F28D 7/1684 165/146 |
| 8,813,688 | B2 | 8/2014 | Pacholski | |
| 9,243,851 | B2 | 1/2016 | Viswanathan et al. | |
| 10,753,687 | B2 * | 8/2020 | Plummer | F28D 7/087 |
| 10,816,277 | B2 * | 10/2020 | Dziubinschi | F28D 1/0391 |
| 2007/0289559 | A1 | 12/2007 | Amada | |
| 2008/0023180 | A1 | 1/2008 | Bunker et al. | |
| 2008/0029243 | A1 | 2/2008 | O'Donnell et al. | |
| 2010/0258280 | A1 * | 10/2010 | O'Donnell | F24H 3/087 165/177 |
| 2012/0006512 | A1 | 1/2012 | Guo et al. | |
| 2014/0262171 | A1 | 9/2014 | Ljubicic | |
| 2014/0262172 | A1 | 9/2014 | Ljubicic | |
| 2015/0308756 | A1 | 10/2015 | Lee | |
| 2016/0109188 | A1 | 4/2016 | Juliana et al. | |
| 2017/0023276 | A1 | 1/2017 | Telian | |
| 2019/0360754 | A1 * | 11/2019 | Yanik | F28D 1/0435 |

FOREIGN PATENT DOCUMENTS

| | | | |
|---|---|---|---|
| WO | 2012169915 | A1 | 12/2012 |
| WO | 2012177154 | A1 | 12/2012 |
| WO | 2017007352 | A1 | 1/2017 |
| WO | 2017007354 | A1 | 1/2017 |
| WO | 2017007355 | A1 | 1/2017 |
| WO | 2017101235 | A1 | 6/2017 |

* cited by examiner

HEAT EXCHANGER TUBES AND TUBE ASSEMBLY CONFIGURATIONS

CROSS-REFERENCE TO RELATED APPLICATIONS

The present application is a divisional application of and claims the benefit of U.S. patent application Ser. No. 15/630,065, titled "Heat Exchanger Tubes and Tube Assembly Configurations" and filed with the U.S. Patent and Trademark Office on Jun. 22, 2017, the entire contents of which are hereby incorporated herein by reference.

TECHNICAL FIELD

Embodiments described herein relate generally to heat exchangers, and more particularly to configurations of HX tubes and tube assemblies for heat exchangers.

BACKGROUND

Heat exchanger, boilers, combustion chambers, water heaters, and other similar devices (generally called heat exchangers or vessels herein) control or alter thermal properties of one or more fluids. In some cases, tubes (also called heat exchanger tubes or HX tubes) disposed within these devices are used to transfer a fluid through a volume of space, thereby altering the thermal properties of the fluid. The temperature of the fluid can increase or decrease, depending on how the device is configured.

SUMMARY

In general, in one aspect, the disclosure relates to a tube for a thermal transfer device. The tube can include at least one wall having an inner surface and an outer surface, wherein the inner surface forms a cavity. The inner surface can be non-cylindrical. The cavity can be configured to receive a fluid that flows continuously along a length of the at least one wall.

In another aspect, the disclosure can generally relate to an array of tubes for a thermal transfer device. The array of tubes can include a tube sheet having multiple apertures that traverse therethrough. The array of tubes can also include a first tube disposed within a first aperture of the plurality of apertures of the tube sheet, where the first tube includes at least one first wall having a first inner surface and a first outer surface, where the first inner surface forms a first cavity, where the first inner surface is non-cylindrical, and where the first cavity is configured to receive a fluid that flows continuously along a first length of the at least one first wall.

These and other aspects, objects, features, and embodiments will be apparent from the following description and the appended claims.

BRIEF DESCRIPTION OF THE DRAWINGS

The drawings illustrate only example embodiments of HX tubes and tube assembly configurations and are therefore not to be considered limiting in scope, as HX tubes and tube assembly configurations may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1B:
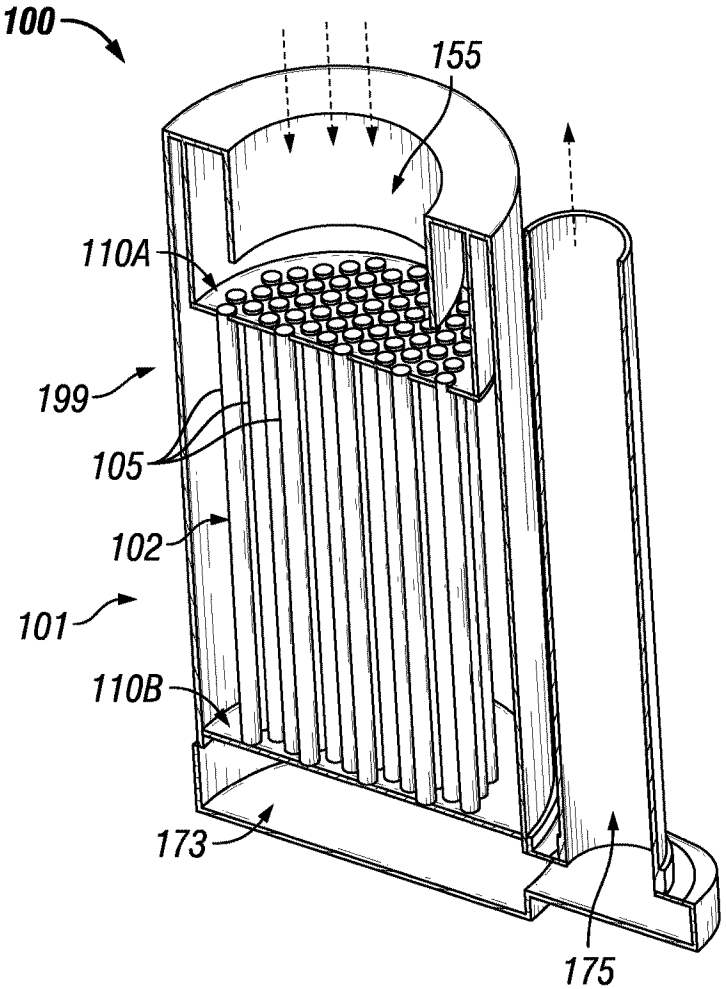
FIG. 1B (Prior Art)
FIGS. 1A and 1B show a prior art boiler in which the example embodiments of HX tubes as described herein can be implemented.

The example embodiments discussed herein are directed to systems, methods, and devices for HX tubes and tube assembly configurations. Example embodiments can be directed to any of a number of thermal transfer devices, including but not limited to boilers, condensing boilers, heat exchangers, and water heaters. Further, one or more of any number of fluids can flow through example HX tubes and/or tube assemblies. Examples of such fluids can include, but are not limited to, water, deionized water, steam, glycol, and dielectric fluids.

Example embodiments can be pre-fabricated or specifically generated (e.g., by shaping a malleable body) for a particular heat exchanger and/or environment. Example embodiments can have standard or customized features (e.g., shape, size, features on the inner surface, pattern, configuration). Therefore, example embodiments described herein should not be considered limited to creation or assembly at any particular location and/or by any particular person.

The HX tubes (or components thereof) described herein can be made of one or more of a number of suitable materials and/or can be configured in any of a number of ways to allow the HX tubes (or devices (e.g., boiler, heat exchanger) in which the HX tubes are disposed) to meet certain standards and/or regulations while also maintaining reliability of the HX tubes, regardless of the one or more conditions under which the HX tubes can be exposed. Examples of such materials can include, but are not limited to, aluminum, stainless steel, ceramic, fiberglass, glass, plastic, and rubber.

As discussed above, heat exchangers can be subject to complying with one or more of a number of standards, codes, regulations, and/or other requirements established and maintained by one or more entities. Examples of such entities can include, but are not limited to, the American Society of Mechanical Engineers (ASME), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). Example HX tubes allow a heat exchanger to continue complying with such standards, codes, regulations, and/or other requirements. In other words, example HX tubes, when used in a heat exchanger, do not compromise compliance of the heat exchanger with any applicable codes and/or standards.

Any example HX tubes, or portions thereof, described herein can be made from a single piece (e.g., as from a mold, injection mold, die cast, 3-D printing process, extrusion process, stamping process, crimping process, and/or other prototype methods). In addition, or in the alternative, example HX tubes (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with HX tubes or heat exchangers in general. Examples of a user may include, but are not limited to, an engineer, a maintenance technician, a mechanic, an employee, a visitor, an operator, a consultant, a contractor, and a manufacturer's representative. Components (e.g., a smooth metal protrusion) and/or features (e.g., dimples) described herein can be used to deform a HX tube, thereby making the cavity formed by the HX tube non-cylindrical.

If a component (e.g., a protruding feature) is added to a HX tube to alter the cylindrical shape of the cavity formed by the HX tube, such component can be coupled to an inner surface of the HX tube using one or more of a number of coupling features. As used herein, a "coupling feature" can couple, secure, fasten, abut, and/or perform other functions aside from merely coupling.

A coupling feature as described herein can allow one or more components (e.g., a protruding feature) of a HX tube to become coupled, directly or indirectly, to another portion (e.g., an inner surface) of the HX tube. A coupling feature can include, but is not limited to, a snap, a clamp, a portion of a hinge, an aperture, a recessed area, a protrusion, a slot, a spring clip, a tab, a detent, a compression fitting, and mating threads. One portion of an example HX tube can be coupled to a component (e.g., a diffuser plate) of a heat exchanger and/or another portion of the HX tube by the direct use of one or more coupling features.

In addition, or in the alternative, a portion of an example HX tube can be coupled to another component of a heat exchanger and/or another portion of the HX tube using one or more independent devices that interact with one or more coupling features disposed on a component of the HX tube. Examples of such devices can include, but are not limited to, a weld, a pin, a hinge, a fastening device (e.g., a bolt, a screw, a rivet), epoxy, adhesive, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. The numbering scheme for the components in the figures herein parallel the numbering scheme for corresponding components described in another figure in that each component is a three digit number and corresponding components have identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of HX tubes will be described more fully hereinafter with reference to the accompanying drawings, in which example embodiments of HX tubes are shown. HX tubes may, however, be embodied in many different forms and should not be construed as limited to the example embodiments set forth herein. Rather, these example embodiments are provided so that this disclosure will be thorough and complete, and will fully convey the scope of HX tubes to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation, and are not meant to limit embodiments of HX tubes. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1A:
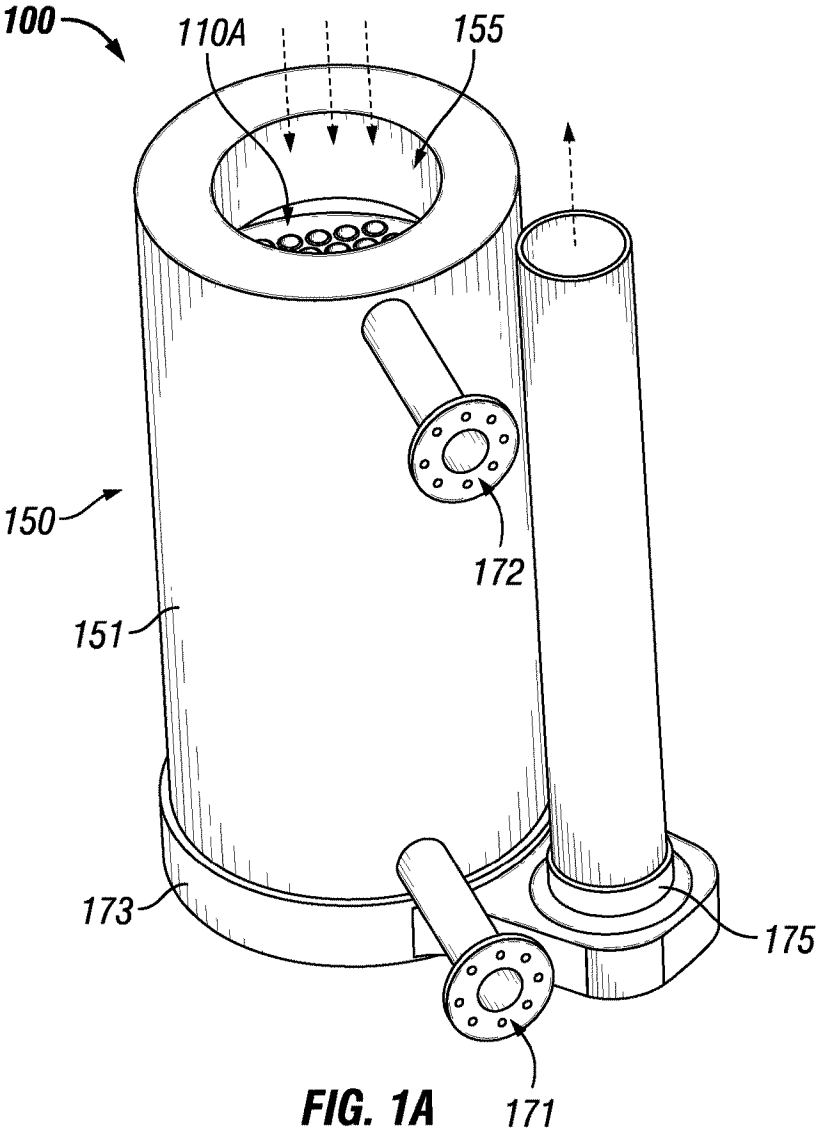
FIG. 1A (Prior Art)

FIGS. 1A and 1B show a boiler 100 with a prior art tube assembly and HX tubes which can be replaced with the example embodiments of HX tubes and tube assemblies described herein. Specifically, FIG. 1A shows a perspective view of the boiler 100, and FIG. 1B shows a cross-sectional perspective view of the boiler 100. Referring to FIGS. 1A and 1B, the boiler 100 includes one or more of any number of components. For example, in this case, the boiler 100 includes at least one wall 151 that forms a cavity 155. Toward the bottom of the boiler is a flue gas collection chamber 173 that provides a bridge between the cavity 155 of the boiler 100 and an exhaust vent 175. Disposed within the cavity 155 in this case are two diffuser plates 110 (top diffuser plate 110A and bottom diffuser plate 110B) and a number of HX tubes 105 disposed between the diffuser plates 110. The two diffuser plates 110 can be called a diffuser assembly 199. The group of tubes 105 can be called a tube assembly 102. The combination of the diffuser assembly 199 and the tube assembly 102 can be called an assembly 101.

The boiler 100 uses a mixture of a gaseous fuel (e.g., natural gas, propane, butane) and air (premixed) to transfer heat to a fluid (e.g., water), and the heated fluid (e.g., water, steam) can be used for some other process or purpose. In some cases, the fuel can be premixed with some other component, such as air. For example, the fuel/air mixture can be introduced into the top of the boiler 100, as shown at the top of FIGS. 1A and 1B. Once inside the top part of the cavity 155, there can be some heat source (e.g., a burner, and ignitor) that raises the temperature of the fuel/air mixture, resulting in combustion and burning of the fuel/air mixture. From there, the resulting hot gases (byproducts of the combustion of the fuel/air mixture) can be directed into the various HX tubes 105 and travel down those HX tubes 105 to the collection chamber 173. The hot gases then continue on to the exhaust vent 175 and leave the boiler 100. The water vapor in the combustion products can either be in the vapor phase (non-condensing mode) or in the liquid phase (condensing mode), depending on the design of the boiler 100.

At the same time another fluid (e.g., water) is brought into the bottom part of the boiler 100 through the inlet 171. Once inside the cavity 155, the fluid comes into contact with the outer surfaces of the HX tubes 105. In many cases, the HX tubes 105 are made of a thermally conductive material. In this way, when the hot gases (from the combustion process) travel down the HX tubes 105, some of the heat from the fuel is transferred to the walls of the HX tubes 105. Further, as the fluid comes into contact with the outer surface of the walls of the HX tubes 105, some of the heat captured by the walls of the tubes HX 105 from the heated fuel is transferred to the fluid in the cavity 155. The heated fluid is drawn up toward the top of the cavity 155 of the boiler 100, and is then drawn out of the boiler 100 through the outlet 172. The heated fluid can then be used for one or more other processes, such as space heating and hot water for use in a shower, a clothes washing machine, and/or a dishwashing machine.

The HX tubes 105 are held in place within the cavity 155 of the boiler by tube sheets and the diffuser plates 110. The diffuser plates 110 can be coupled to an interior surface (e.g., disposed in a recess of an inner surface of the wall 151) of the boiler 100. Although the major role of the diffuser plates 110 is to redirect the flow and to make the flow uniform inside the cavity 155 and around the HX tubes 105, from a structural point of view, the diffuser plates 110 can also be used, in conjunction with tube sheets, to maintain the position of the tubes HX 105 within the cavity 155.

Figure 2:
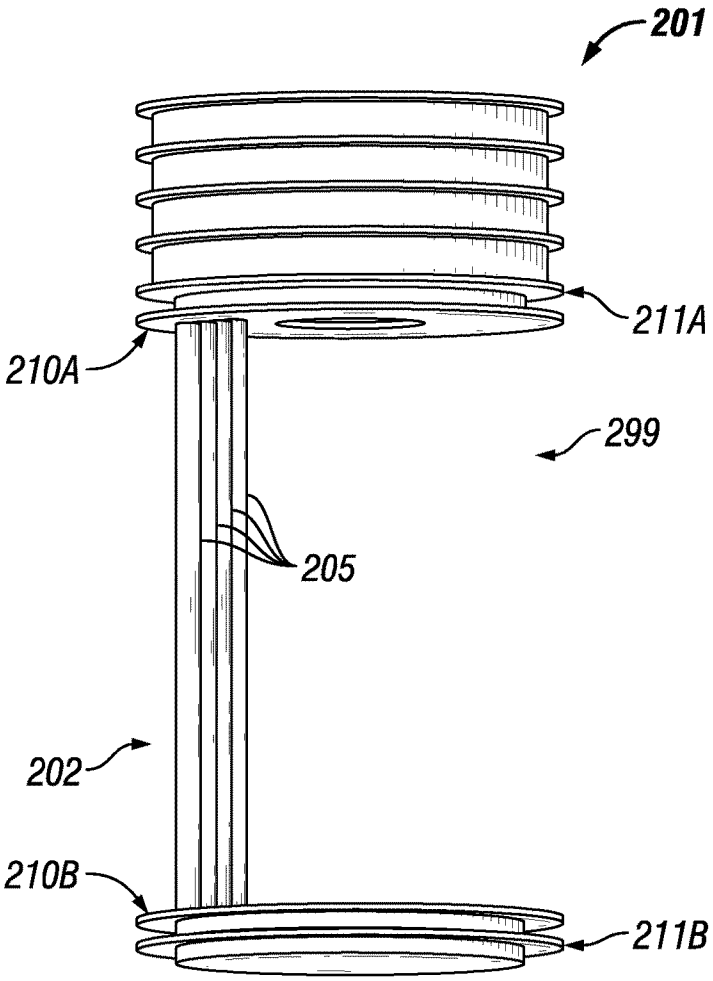
FIG. 2 (Prior Art)
FIG. 2 shows a subassembly for a boiler as currently used in the art.

FIG. 2 shows a subassembly 201 for a boiler currently used in the art. Referring to FIGS. 1A-2, the subassembly 201 includes two diffuser plates 210, with a top diffuser plate 210A being disposed near the top end of the HX tubes 205 close to a top tube sheet 211A, and with the bottom diffuser plate 210B being disposed near the bottom end of the HX tubes 205 close to a bottom tube sheet 211B. The HX tubes 205 collectively form a tube assembly 202.

As can be seen in FIG. 2, the outer surface of the HX tubes 205 used in the current art is cylindrical in shape, with no curvature, dimples, or other similar protruding features. Further, the inner surface of the HX tubes 205 that form the cavity through which the hot gases travel are also cylindrical (tubular, with no features) as currently used in the art. As shown below, example embodiments alter both the inner surface and the outer surface of the example HX tubes described herein, resulting in increased efficiency and improved heat transfer. For example, tests have shown that example HX tubes (e.g., HX tube 205) can result in at least a 1% improvement in heat transfer performance and, even more significantly, at least 25% less pressure drop throughout the HX tube. This reduced pressure puts less stress on the example HX tube, thereby allowing the example HX tubes to operate for longer periods of time in terms of decreased performance or failure relative to the HX tubes used today.

Figure 3A:
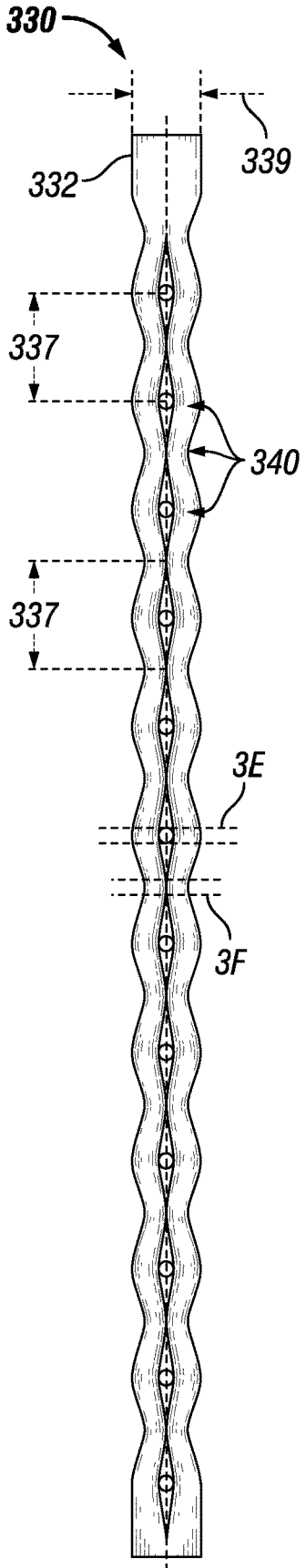
FIGS. 3A-3F show various views of HX tubes in accordance with certain example embodiments.
Figure 3B:
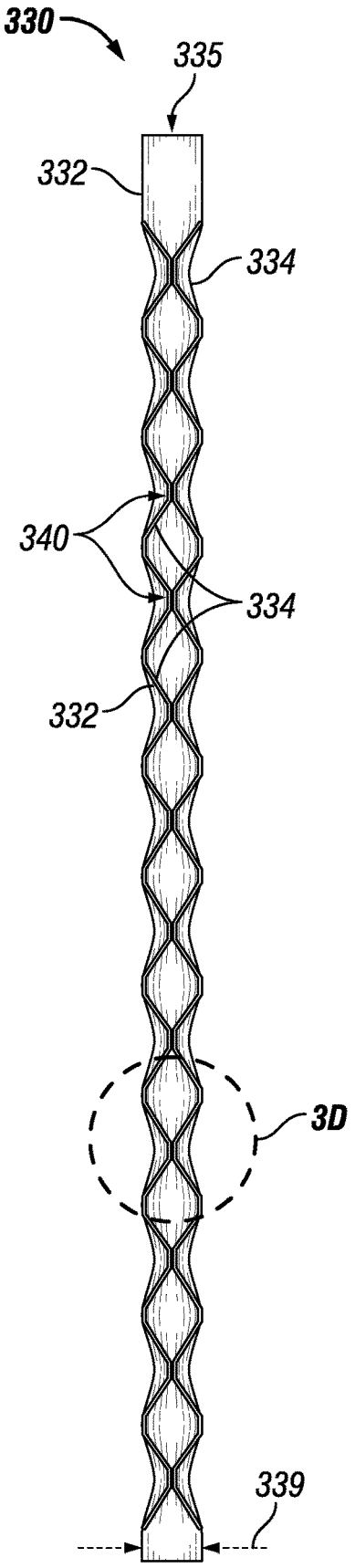
Figure 3C:
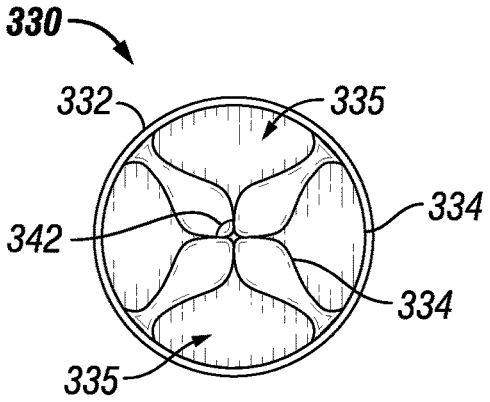
Figure 3D:
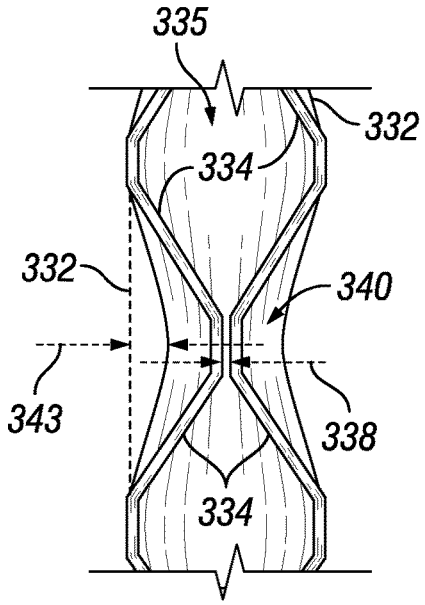
Figure 3E:
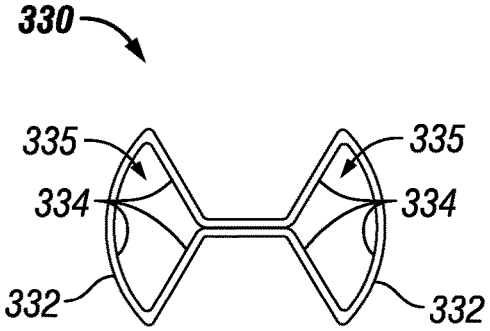
Figure 3F:
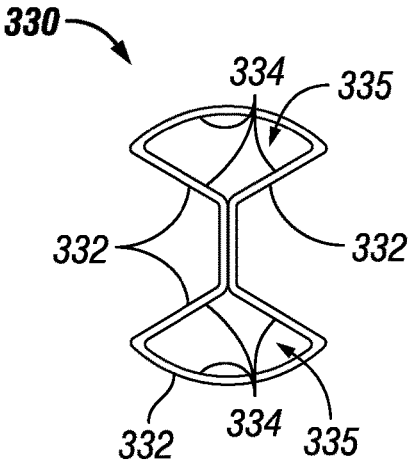

FIGS. 3A-3F show various views of a HX tube 330 in accordance with certain example embodiments. Specifically, FIG. 3A shows a side view of the HX tube 330. FIG. 3B shows a cross-sectional side view of the HX tube 330. Specifically, FIG. 3C shows a semi-transparent top view of the HX tube 330. FIG. 3D shows a detailed view of FIG. 3B. FIG. 3E shows a top view of a cross-sectional segment of the HX tube 330. FIG. 3F shows a top view of another cross-sectional segment of the HX tube 330.

Referring to FIGS. 1A-3F, the HX tube 330 starts out with a cylindrical shape, as shown with the HX tubes 105 of FIG. 1B and the HX tubes 205 of FIG. 2. However, according to certain example embodiments, the HX tube 330 of FIGS. 3A-3F, having outer diameter 339, undergoes one or more processes (e.g., crimping, twisting, bending) so that the HX tube 330 (and, more specifically, the inner surface 334 of the HX tube 330) is non-cylindrical. In other words, while the cavities formed by the inner surface of the HX tubes 105 of FIG. 1B and the HX tubes 205 of FIG. 2 are cylindrical, the cavity 335 formed by the inner surface of an example HX tube (e.g., HX tube 330) is not cylindrical.

In this way, using example embodiments, fluids (e.g., hot gases that are byproducts of the combustion of the fuel/air mixture in the heat exchanger) that flow through the cavities 335 of the HX tubes 330 can be better controlled, resulting in a more efficient process and less stress on the HX tubes 330 due to pressure, which in turn results in less fuel consumed, lower costs incurred, and longer useful life of the various components (e.g., HX tubes) of the heat exchanger.

In this example, the HX tube 330 has an inner surface 334 (also called an inner wall surface 334) and an outer surface 332 (also called an outer wall surface 332). At regular intervals (denoted by distances 337 in FIG. 3A), a number of crimps are made in the HX tube 330, creating a number of dimples 340 (a type of protruding feature relative to the cavity 335). The dimples 340 on the HX tube 330 are simultaneously created on opposing sides of the HX tube 330, creating a mirror image of inward dimples 340, as shown in FIGS. 3E and 3F. These dimples 340 can be made so far inward that the inner surface 334 of the HX tube 330 makes contact with itself, as shown in FIGS. 3E and 3F, at the location in the cavity 335 where the dimples 340 are formed.

Alternatively, as shown in FIG. 3D, there can be a gap 338 that separates the inner surface 334 from itself at the location in the cavity 335 where the dimples 340 are formed. As yet another alternative, rather than two opposing dimples 340 at a particular location along the length of the HX tube 340, there can be a single dimple 340 or three or more dimples 340 formed at such a location along the length of the HX tube 340. In such a case, the inner surface 334 can contact itself as a result of the dimple 340, or there can be a gap 338 between the inner surfaces 334 where the dimple 340 is formed. Within a HX tube 340, the gap 338 between pairs of opposing dimples 340 can be the same as, or be different than, the gap 338 between one or more other pairs of opposing dimples 340.

In any case, regardless of the number of dimples 340 or whether the inner surface 334 contacts itself at a location where the one or more dimples 340 are formed, the dimples 340 do not completely close off the cavity 335. In other words, the cavity 335 is continuous along the length of the HX tube 330, although in some locations (e.g., where the dimples 340 are formed) of the HX tube 330, the cavity 335 is smaller relative to other locations (e.g., where no dimples 340 are formed) of the HX tube 330.

As discussed above, opposing pairs of dimples 340 in FIGS. 3A-3F are created at regular intervals 337 along the length of the HX tube in a top-bottom (when viewed from above) orientation. In addition, opposing pairs of dimples 340 in FIGS. 3A-3F are created at regular intervals 337 along the length of the HX tube in a left-right (when viewed from above) orientation. The left-right oriented dimples 340 are also equally spaced along the length of the HX tube 330 relative to the adjacent top-bottom oriented dimples 340. In other words, one pair of dimples 340 can be rotated 90 degrees (or any other degrees) about the longitudinal axis of the HX tube 330 relative to an adjacent pair of dimples 340.

In other words, the left-right oriented dimples 340 are separated from the adjacent top-bottom oriented dimples 340 along the length of the HX tube 330 by a distance equal to half of distance 337. Alternatively, the distance 337 between adjacent top-bottom oriented dimples 340, the distance 337 between adjacent left-right oriented dimples 340, and/or the distance between adjacent top-bottom oriented dimples 340 and left-right oriented dimples 340 along the length of the HX tube 330 can vary.

When adjacent dimples 340 along the length of the HX tube 330 have a different orientation (e.g., left-right followed by top-bottom) with respect to each other, a dimple angle 342 (also called a protruding feature angle 342) can be formed. In this example, the dimple angle is approximately 90°. The dimple angle can be any other angle, including but not limited to an acute angle, an obtuse angle, and 0°. Further, the dimple angle between one set of adjacent dimples 340 along the length of the HX tube 330 can be substantially the same as, or different than, the dimple angle between another set of adjacent dimples 340 along the length of the HX tube 330.

When there are multiple dimples 340 along a horizontal slice of the HX tube 330, those dimples 340 can meet at or converge toward any point within the cavity 335. For example, as shown in FIGS. 3C-3F, the dimples 340 can converge toward or meet at, as the case may be, the center of the cavity 335 when viewed from above. Further, when dimples 340 are formed in the HX tube 330, the slope at which the dimple 340 is made can vary. In other words, the amount of the outer surface 332 of the HX tube that is affected (e.g., bent inward) by a dimple 340 can vary.

This slope of a dimple 340 can be measured in one or more of a number of ways. For example, as shown in FIG. 3D, the slope can be determined by viewing the dimple from the side and measuring the distance 343 between the outer perimeter 332 formed by the dimple 340 and where the outer perimeter 332 would have been without the dimple 340. Any or all of the factors and characteristics of a dimple 340, such as those described herein, can be controlled to generate a desired effect regarding the flow of a fluid through the cavity 335 and reduced pressure drop along the length of the HX tube 330.

Figure 4A:
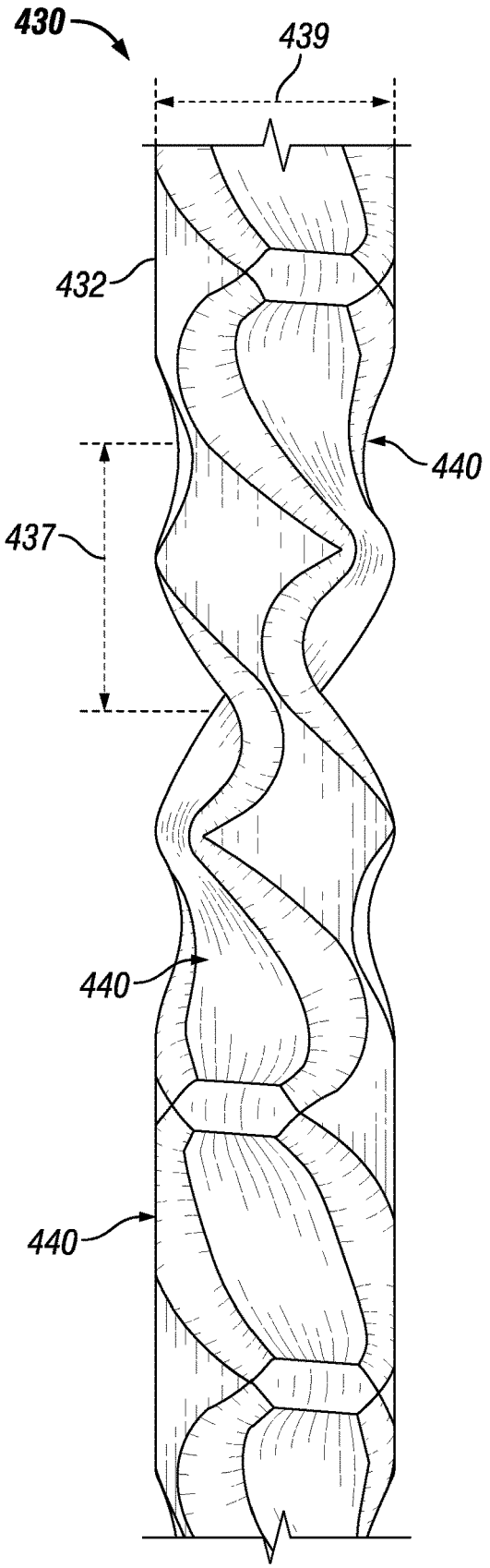
FIGS. 4A and 4B show various views of another HX tube in accordance with certain example embodiments.
Figure 4B:
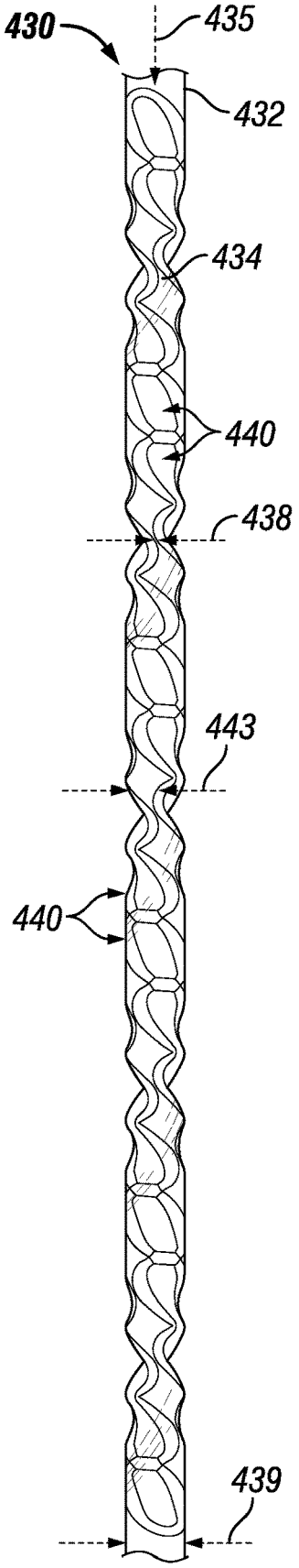

FIGS. 4A and 4B shows various views of another HX tube 430 in accordance with certain example embodiments. Specifically, FIG. 4A shows a side view of the HX tube 430. FIG. 4B shows a semi-transparent cross-sectional side view of the HX tube 430. Referring to FIGS. 1A-4B, the HX tube 430 of FIGS. 4A and 4B is substantially the same as the HX tube 330 of FIGS. 3A-3F, except as described below.

For example, rather than starting as a cylindrical tube before dimples or other similar features are added to the HX tube to alter the cylindrical shape of the cavity formed along the length of the HX tube, as was the case with the HX tube 330 of FIGS. 3A-3F, the HX tube 430 of FIGS. 4A and 4B, having outer diameter 439, is twisted about an axis formed along the length of the HX tube 430. In addition, pairs of opposing crimps are made at regular intervals (distance 437) along the length of the HX tube 430, forming pairs of opposing dimples 440 that are directed toward (e.g., separated by gap 438), or make contact with, each other.

In this case, it takes eight sets of adjacent dimples 440 along the length of the HX tube 430 for the pattern to repeat (i.e., for a dimple set to rotate one full turn, or 360°). As such, the dimple angle formed between adjacent sets of dimples 440 along the length of the HX tube 430 in this example is approximately 22.5°. Also, the slope of the dimples 440 in this case, measured by distance 443, is such that more of the outer surface 432 is deformed by each dimple 440 relative to the slope of the dimples 340 of FIGS. 3A-3F.

When a heat exchanger uses a tube assembly (i.e., has a number of HX tubes 430), one HX tube 430 can have the same, or different, characteristics (e.g., number of dimples, location of dimples, slope of dimples, distance between adjacent dimples, dimple angle between adjacent dimples, gap between dimples in a dimple set) compared to the characteristics of one or more of the other HX tubes in the tube assembly.

Figure 5A:
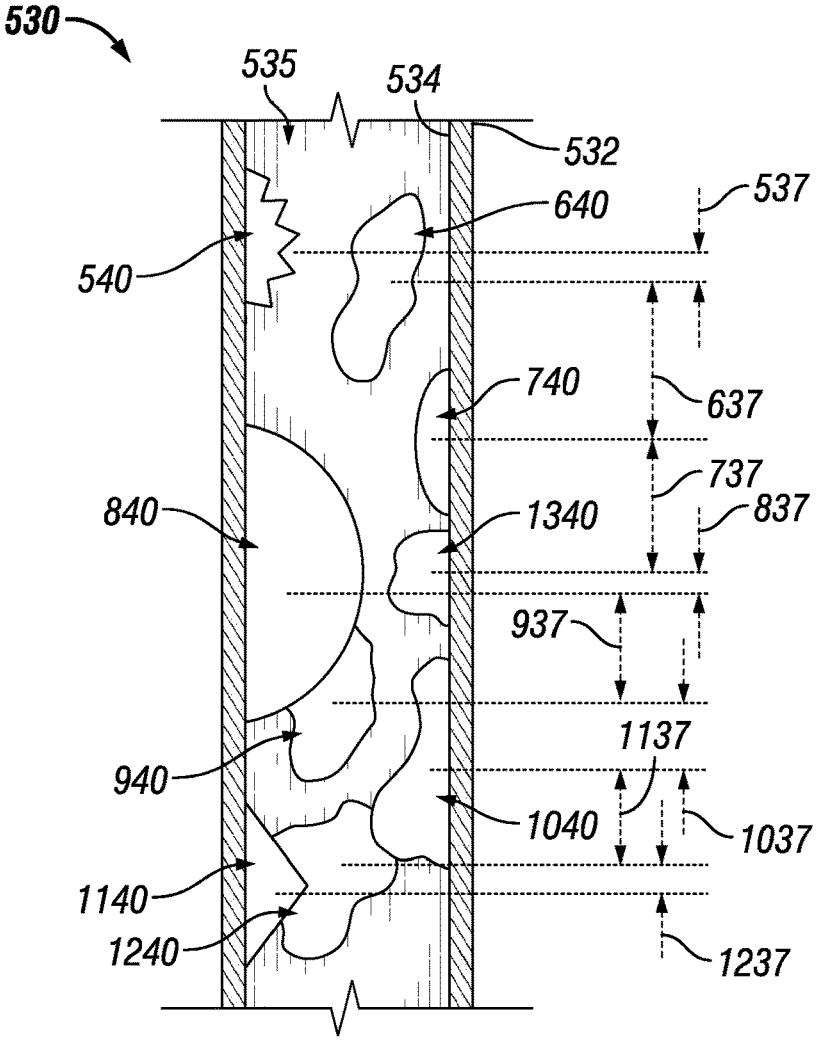
FIGS. 5A and 5B show various views of yet another HX tube in accordance with certain example embodiments.
Figure 5B:
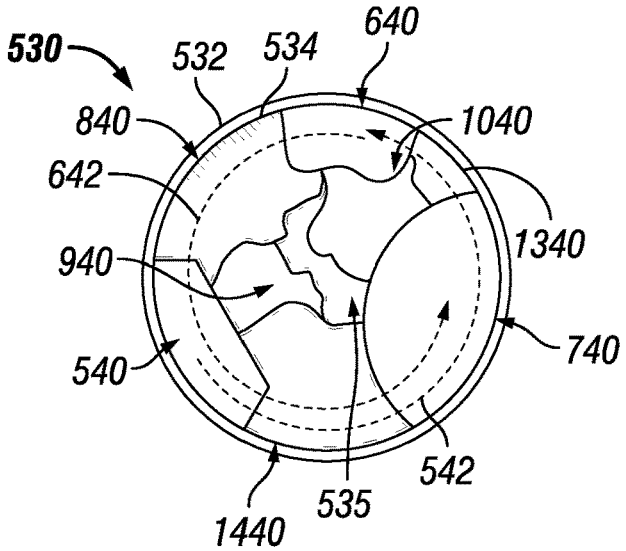

FIGS. 5A and 5B show various views of yet another HX tube 530 in accordance with certain example embodiments. Specifically, FIG. 5A shows a cross-sectional side view of the HX tube 530. FIG. 5B shows a top view the HX tube 530. Referring to FIGS. 1A-5B, the HX tube 530 of FIGS. 5A and 5B is substantially similar to the example HX tubes described above, except as described below.

For example, rather than deforming (e.g., crimping) the HX tube 530 of FIGS. 5A and 5B to add protruding features (e.g., dimples) relative to the cavity 535 in order to achieve a non-cylindrical cavity 535 formed by the HX tube 530, one or more components (forms of protruding features) can be coupled, directly or indirectly, to the inner surface 534 of the HX tube 530. In this case, multiple protruding features are welded to the inner surface 534 of the HX tube 530. Specifically, the HX tube 530 includes protruding feature 540, protruding feature 640, protruding feature 740, protruding feature 840, protruding feature 940, protruding feature 1040, protruding feature 1140, protruding feature 1240, and protruding feature 1340 are disposed at varying points along the inner surface 534 of the HX tube 530. Since the various protruding features of FIGS. 5A and 5B are disposed within the cavity 535, the cavity 535 becomes non-cylindrical while still being continuous along the length of the HX tube 530.

In this example, each protruding feature have a number of characteristics (e.g., shape, size, contours, location) that are different from the remainder of the protruding features. For example, protruding feature 540 and protruding feature 1140 have at least one outer surface that has a planar segment, while the remainder of protruding features do not. As another example, protruding feature 640, protruding feature 940, protruding feature 1040, protruding feature 1240, and protruding feature 1340 have irregular, random shapes, while the remainder of the protruding features have regular (albeit different) shapes.

Not only are the shapes and sizes of the protruding features of FIGS. 5A and 5B different with respect to each other, their locations along the inner surface 534 are as well. For example, the distance 537 that separates protruding feature 540 and protruding feature 640 is different than the distance 637 that separates protruding feature 740 and protruding feature 640, which is different than the distance 737 that separates protruding feature 740 and protruding feature 1340, which is different than the distance 837 that separates protruding feature 840 and protruding feature 1340, which is different than the distance 937 that separates protruding feature 840 and protruding feature 940, which is different than the distance 1037 that separates protruding feature 1040 and protruding feature 940, which is different than the distance 1137 that separates protruding feature 1040 and protruding feature 1240, which is different than the distance 1237 that separates protruding feature 1140 and protruding feature 1240.

As can be seen in FIG. 5B, the relative location of the protruding features when viewed from above is also random and irregular. As a result, the protruding feature angle formed between adjacent protruding features along the length of the HX tube 530 varies. For example, protruding feature angle 542 formed between protruding feature 540 and protruding feature 640 is approximately 200°, while protruding feature angle 642 formed between protruding feature 740 and protruding feature 640 is approximately 260°.

As can be seen, the outer surface (the part of the protruding features exposed to the cavity 535 when the protruding features are coupled to the inner surface 532 of the HX tube 530) can be smooth, rough, curved, jagged, sawtoothed, squared, concave, convex, and/or have any other features. These protruding features in FIGS. 5A and 5B provide the efficiency benefits of the cavity 535 being non-cylindrical without deforming the HX tube 530. In other words, the outer surface 532 of the HX tube 530 is cylindrical.

An example HX tube described herein have a non-cylindrical cavity formed by an inner wall surface of the HX tube. Making the cavity formed by the inner wall surface of an HX tube non-cylindrical can be accomplished in one or more of a number of ways. For example, the wall of a HX tube can be deformed. In such a case, deforming the wall of the HX tube to form the non-cylindrical cavity can be accomplished in one or more of a number of ways using one or more of a number of features. For example, an example HX tube can be crimped in multiple locations to form multiple dimples (a form of protruding feature).

The cavity of an example HX tube can be made non-cylindrical by coupling one or more protruding features (separate components) to a cylindrical inner surface of the HX tube. While the cavity of an example HX tube is continuous along the length of the HX tube, the cavity is non-cylindrical. By carefully engineering the various characteristics of each dimple formed in an example HX tube, the flow of fluid through the cavity of the HX tube can become more efficient, providing a number of benefits, including but not limited to lower fuel consumption, lower costs, and less waste. Example HX tubes can also create a significantly reduced pressure drop throughout the HX tubes. Example HX tubes can further allow a heat exchanger to comply with any applicable standards and/or regulations. Example embodiments can be mass produced or made as a custom order.

Accordingly, many modifications and other embodiments set forth herein will come to mind to one skilled in the art to which example HX tubes pertain having the benefit of the teachings presented in the foregoing descriptions and the associated drawings. Therefore, it is to be understood that example HX tubes are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A tube for a thermal transfer device, wherein the tube comprises:

at least one wall comprising a length, an inner surface, and an outer surface, wherein the inner surface forms a cavity;

a first dimple and a second dimple disposed opposite each other at a first location along the length of the at least one wall to form a first pair of opposing dimples, the first dimple having a first planar surface and the second dimple having a second planar surface, the first planar surface and the second planar surface being oriented parallel to the length of the at least one wall and in contact with each other such that the inner surface of the at least one wall between the first pair of opposing dimples contacts itself; and a third dimple and a fourth dimple disposed opposite each other at a second location along the length of the at least one wall to form a second pair of opposing dimples adjacent the first pair of opposing dimples a first distance from the first pair of opposing dimples, the third dimple having a third planar surface and the fourth dimple having a fourth planar surface, the third planar surface and the fourth planar surface being oriented parallel to the length of the at least one wall and in contact with each other such that the inner surface of the at least one wall between the second pair of opposing dimples contacts itself, wherein the first planar surface and the second planar surface of the first pair of opposing dimples forms a first non-zero angle relative to the third planar surface and the fourth planar surface of the second pair of opposing dimples when viewed along a longitudinal axis of the at least one wall, wherein the third planar surface and the fourth planar surface of the second pair of opposing dimples forms a second non-zero angle relative to the fifth planar surface and the sixth planar surface of the third pair of opposing dimples when viewed along the longitudinal axis of the at least one wall, the second non-zero angle being different from the first non-zero angle, and wherein longitudinal spacing between adjacent pairs of opposing dimples is substantially uniform along the length of the at least one wall.

2. The tube of claim 1, wherein the cavity at the first pair of opposing dimples and the second pair of opposing dimples is configured to allow fluid to flow therethrough.

3. The tube of claim 1, wherein the first non-zero angle is approximately 90°.

4. The tube of claim 1, wherein the first non-zero angle is approximately 22.5°.

5. The tube of claim 1, wherein the at least one wall is rotationally twisted along the length.

6. The tube of claim 1, wherein the first pair of opposing dimples, the second pair of opposing dimples, and the third pair of opposing dimples are shaped substantially identical to each other.

7. The tube of claim 1, wherein each dimple of the first pair of opposing dimples, the second pair of opposing dimples, and the third pair of opposing dimples comprises a sloped edge.

8. The tube of claim 1, wherein at least a portion of the at least one wall is cylindrical.

9. The tube of claim 1, wherein the first pair of opposing dimples, the second pair of opposing dimples, and the third pair of opposing dimples are disposed on an entirety of the length of the at least one wall.

10. The tube of claim 1, wherein the at least one wall is rotationally twisted substantially uniformly along the length.

11. An array of tubes for a thermal transfer device, wherein the array of tubes comprises:

a tube sheet comprising a plurality of apertures that traverse therethrough; and a first tube disposed within a first aperture of the plurality of apertures of the tube sheet, wherein the first tube comprises:

at least one first wall having a first length, a first inner surface, and a first outer surface, wherein the first inner surface forms a first cavity; and a first dimple and a second dimple disposed opposite each other at a first location along the length of the at least one wall to form a first pair of opposing dimples, the first dimple having a first planar surface and the second dimple having a second planar surface, the first planar surface and the second planar surface being oriented parallel to the length of the at least one wall and in contact with each other such that the inner surface of the at least one wall between the first pair of opposing dimples contacts itself;

a third dimple and a fourth dimple disposed opposite each other at a location along the length of the at least one wall to form a second pair of opposing dimples adjacent the first pair of opposing dimples a first distance from the first pair of opposing dimples, the third dimple having a third planar surface and the fourth dimple having a fourth planar surface, the third planar surface and the fourth planar surface being oriented parallel to the length of the at least one wall and in contact with each other such that the inner surface of the at least one wall between the third pair of opposing dimples contacts itself, a fifth dimple and a sixth dimple disposed opposite each other at a third location along the length of the at least one wall to form a third pair of opposing dimples adjacent the second pair of opposing dimples a second distance from the first pair of opposing dimples, the fifth dimple having a fifth planar surface and the sixth dimple having a sixth planar surface, the fifth planar surface and the sixth planar surface being oriented parallel to the length of the at least one wall and in contact with each other such that the inner surface of the at least one wall between the third pair of opposing dimples contacts itself, wherein the first planar surface and the second planar surface of the first pair of opposing dimples forms a first non-zero angle relative to the third planar surface and the fourth planar surface of the second pair of opposing dimples when viewed along a longitudinal axis of the at least one first wall, wherein the third planar surface and the fourth planar surface of the second pair of opposing dimples forms a second non-zero angle relative to the fifth planar surface and the sixth planar surface of the third pair of opposing dimples when viewed along the longitudinal axis of the at least one first wall, the second non-zero angle being different from the first non-zero angle, and wherein longitudinal spacing between adjacent pairs of opposing dimples is substantially uniform along the length of the at least one wall.

12. The array of tubes of claim 11, further comprising:

a second tube disposed within a second aperture of the plurality of apertures of the tube sheet, wherein the second tube comprises:

at least one second wall having a second length, a second inner surface, and a second outer surface, wherein the second inner surface forms a second cavity; and a seventh dimple and eighth dimple disposed opposite each other at a first location along the second length of the at least one second wall to form a fourth pair of opposing dimples, the seventh dimple having a seventh planar surface and the eighth dimple having an eighth planar surface, the seventh planar surface and the eighth planar surface being oriented parallel to the second lengths of the at least one second wall and in contact with each other such that the inner surface of the at least one second wall between the fourth pair of opposing dimples contacts itself;

a ninth dimple and a tenth dimple disposed opposite each other at a second location along the second length of the at least one second wall to form a fifth pair of opposing dimples adjacent the fourth pair of opposing dimples a first distances from the fourth pair of opposing dimples, the ninth dimple having a ninth planar surface and the tenth dimple having a tenth planar surface, the ninth planar surface and the tenth planar surface being oriented parallel to the second length of the at least one second wall and in contact with each other such that the inner surface of the at least one wall between the fifth pair of opposing dimples contacts itself; and an eleventh dimple and a twelfth dimple disposed opposite each other at a third location along the second length of the at least one second wall to form a sixth pair of opposing dimples adjacent the fifth pair dimples a second distances from the fourth pair of opposing dimples, the eleventh dimple having a eleventh planar surface and the twelfth dimple having a twelfth planar surface, the eleventh planar surface and the twelfth planar surface being oriented parallel to the second length of the at least one second wall and in contact with each other such that the inner surface of the at least one wall between the sixth pair of opposing dimples contacts itself; and wherein the seventh planar surface and the eighth planar surface of the fourth pair of opposing dimples forms a third non-zero angle relative to the ninth planar surface and the tenth planar surface of the fifth pair of opposing dimples when viewed along a longitudinal axis of the at least one second wall, and wherein the ninth planar surface and the tenth planar surface of the fifth pair of opposing dimples forms a fourth non-zero angle relative to the eleventh planar surface and the twelfth planar surface of the sixth pair of opposing dimples when viewed along the longitudinal axis of the at least one second wall, the fourth non-zero angle being different from the third non-zero angle.

13. The array of tubes of claim 12, wherein the at least one first wall is rotationally twisted about the longitudinal axis of the at least one first wall along the first length, and wherein the at least one second wall is rotationally twisted about the longitudinal axis of the at least one second wall along the second length.

14. The array of tubes of claim 13, wherein the at least one first wall is rotationally twisted to a different extent that the at least one second wall.

* * * * *